US010780490B2

(12) United States Patent
Sedén et al.

(10) Patent No.: US 10,780,490 B2
(45) Date of Patent: Sep. 22, 2020

(54) ELECTROMAGNETIC BRAKE SYSTEM AND METHOD OF CONTROLLING AN ELECTROMAGNETIC BRAKE SYSTEM

(71) Applicant: ABB Schweiz AG, Baden (CH)

(72) Inventors: Martin Tobias Sedén, Västerås (SE); Anders Lehman, Bromma (SE); Jan-Erik Eriksson, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/620,705

(22) PCT Filed: May 29, 2018

(86) PCT No.: PCT/EP2018/063987
§ 371 (c)(1),
(2) Date: Dec. 9, 2019

(87) PCT Pub. No.: WO2018/228812
PCT Pub. Date: Dec. 20, 2018

(65) Prior Publication Data

US 2020/0156146 A1 May 21, 2020

(30) Foreign Application Priority Data

Jun. 16, 2017 (EP) ..... 17176292

(51) Int. Cl.
*B22D 11/049* (2006.01)
*B22D 11/115* (2006.01)
(Continued)

(52) U.S. Cl.
CPC ..... *B22D 11/115* (2013.01); *B22D 11/04* (2013.01); *B22D 11/049* (2013.01);
(Continued)

(58) Field of Classification Search
CPC .... B22D 11/049; B22D 11/115; B22D 11/186
See application file for complete search history.

(56) References Cited

U.S. PATENT DOCUMENTS 6,253,832 B1 * 7/2001 Hallefalt ..... B22D 11/115 164/466
6,513,575 B1 * 2/2003 Svahn ..... B22D 11/115 164/466
(Continued)

FOREIGN PATENT DOCUMENTS

EP 0922512 A1 6/1999
KR 20030036247 A 5/2003
(Continued)

OTHER PUBLICATIONS

Korean Office Action and Translation Application No. KR 10-2019-7033719 Completed: Mar. 19, 2020 13 pages.
(Continued)

*Primary Examiner* — Kevin E Yoon
(74) *Attorney, Agent, or Firm* — Whitmyer IP Group LLC

(57) ABSTRACT

An electromagnetic brake system for a metal-making process. The electromagnetic brake system includes a two-level magnetic structure, in particular an upper magnetic core structure configured to be mounted to an upper portion of a mold and a lower magnetic core structure configured to be mounted to a lower portion of a mold. Lateral coils on the upper magnetic structure are configured to be controlled to generate a first magnetic field in a first field direction and inner coils are configured to be controlled to generate a second magnetic field in a second field direction, simultaneously with the first magnetic field. The lower magnetic core structure has lower coils which are configured to be controlled to generate a third magnetic field in the first direction simultaneously as the lateral coils and the inner coils generate their fields.

21 Claims, 6 Drawing Sheets

(51) Int. Cl.

| | |
|---|---|
| ***B22D 11/18*** | (2006.01) |
| ***B22D 11/04*** | (2006.01) |
| *B22D 11/103* | (2006.01) |
| *B22D 11/12* | (2006.01) |
| *B22D 11/20* | (2006.01) |
| *B22D 41/50* | (2006.01) |

(52) U.S. Cl.
CPC ..... *B22D 11/186* (2013.01); *B22D 11/103* (2013.01); *B22D 11/122* (2013.01); *B22D 11/20* (2013.01); *B22D 41/50* (2013.01)

(56) References Cited

U.S. PATENT DOCUMENTS

| | | | | |
|---|---|---|---|---|
| 6,712,124 | B1 * | 3/2004 | Yamane | B22D 11/115 164/468 |
| 2004/0182539 | A1 | 9/2004 | Yamane et al. | |
| 2005/0039876 | A1 | 2/2005 | Eriksson | |
| 2005/0045303 | A1 * | 3/2005 | Itoyama | B22D 11/115 164/453 |
| 2007/0272388 | A1 * | 11/2007 | Miki | B22D 11/115 164/466 |
| 2012/0228924 | A1 * | 9/2012 | Hatano | B60T 8/4081 303/6.01 |
| 2017/0326626 | A1 * | 11/2017 | Han | B22D 11/115 |

FOREIGN PATENT DOCUMENTS

| | | | |
|---|---|---|---|
| KR | 20140095100 | A | 7/2014 |
| KR | 20170054544 | A | 5/2017 |
| RU | 2212977 | C2 | 9/2003 |
| WO | 2013091701 | A1 | 6/2013 |
| WO | 2016078718 | A1 | 5/2016 |

OTHER PUBLICATIONS

International Search Report and Written Opinion of the International Searching Authority Application No. PCT/EP2018/063987 completed: Jul. 6, 2018; dated Jul. 17, 2018 15 pages.
European Search Report Application No. EP 17 17 6292 Completed: Oct. 19, 2017;dated Nov. 2, 2017 6 pages.
Russian International Search Report and Translation Application No. 2019144342 completed: Jun. 22, 2020 26 pages.

* cited by examiner

ELECTROMAGNETIC BRAKE SYSTEM AND METHOD OF CONTROLLING AN ELECTROMAGNETIC BRAKE SYSTEM

TECHNICAL FIELD

The present disclosure generally relates to metal making. In particular, it relates to an electromagnetic brake system for a metal-making process and to a method of controlling molten metal flow in a metal-making process.

BACKGROUND

In metal-making, for example steelmaking, metal can be produced from iron ore in a blast-furnace and converter or as scrap metal and/or direct reduced iron, melted in an electric arc furnace (EAF). The molten metal may be tapped from the EAF to one or more metallurgical vessels, for example to a ladle and further to a tundish. The molten metal may in this manner undergo suitable treatment, both in respect of obtaining the correct temperature for molding, and for alloying and/or degassing, prior to the molding process.

When the molten metal has been treated in the above-described manner, it may be discharged through a submerged entry nozzle (SEN) into a mold, typically an open-base mold. The molten metal partially solidifies in the mold. The solidified metal that exits the base of the mold is further cooled as it passed between a plurality of rollers in a spray-chamber.

As the molten metal is discharged into the mold, undesired turbulent molten metal flow around the meniscus may occur. This flow may lead to slag entrainment due to excessive surface velocity or to surface defects due to surface stagnation or level fluctuations. Further defects may be caused by non-metallic inclusions from previous process steps that are not able to surface and be secluded by the slag layer on top of the meniscus.

In order to control the fluid flow and affect the conditions for stable and clean solidification of the metal, the mold may be provided with an electromagnetic brake (EMBr). The EMBr comprises a magnetic core arrangement which has a number or teeth, and which magnetic core arrangement extends along the long sides of the mold. The EMBr is beneficially arranged in level with the SEN, i.e. at the upper portion of the mold. A respective coil, sometimes referred to as a partial coil, is wound around each tooth. These coils may be connected to a drive that is arranged to feed the coils with a direct (DC) current. A static magnetic field is thereby created in the molten metal. The static magnetic field acts as a brake and a stabilizer for the molten metal. The flow at the upper regions, close to the meniscus of the molten metal, may thereby be controlled. As a result, better surface conditions may be obtained.

WO2016078718 discloses an electromagnetic brake system for a metal-making process. The electromagnetic brake system comprises a first magnetic core arrangement having a first long side and a second long side, which first long side has Nc teeth and which second long side has Nc teeth, wherein the first long side and the second long side are arranged to be mounted to opposite longitudinal sides of an upper portion of a mold, a first set of coils, wherein the first set of coils comprises 2Nc coils, each coil being wound around a respective tooth of the first magnetic core arrangement, and Np power converters, with Np being an integer that is at least two and Nc is an integer that is at least four and evenly divisible with Np, wherein each power converter is connected to a respective group of 2Nc/Np series-connected coils of the first set of coils, and wherein each of the Np power converters is configured to feed a DC current to its respective group of 2Nc/Np series-connected coils. This disclosure further relates to a method of controlling molten metal flow in a metal-making process.

The utilization of the electromagnetic brake system in itself does however not provide optimal fluid flow control of the molten metal near the meniscus, along the entire width of the mold.

SUMMARY

Thorough quality investigations of steel quality in slabs promote the usage of double roll flow in slab casting for optimal inclusion removal. This flow pattern guides the jet from the SEN nozzle to the narrow face of the mold, then upward toward the meniscus surface after which the upper recirculation loop follows the meniscus from the narrow face toward the SEN. Depending on casting conditions, this flow pattern is more or less difficult to achieve.

In view of the above, an object of the present disclosure is to provide an electromagnetic brake system and a method of controlling molten metal flow in a metal-making process which solves or at least mitigates the problems of the prior art.

There is hence according to a first aspect of the present disclosure provided an electromagnetic brake system for a metal-making process, wherein the electromagnetic brake system comprises: an upper magnetic core structure having a first long side and a second long side, wherein the first long side and the second long side are configured to be mounted to opposite longitudinal sides of an upper portion of a mold, each of the first long side and the second long side being provided with a plurality of first teeth, a lower magnetic core structure having a third long side and a fourth long side, wherein the third long side and the fourth long side are configured to be mounted to opposite longitudinal sides of a lower portion of a mold, each of the third long side and the fourth long side being provided with a plurality of second teeth, wherein the upper magnetic core structure and the lower magnetic core structure are magnetically decoupled, lateral coils wound around respective lateral first teeth of the first long side and the second long side, wherein the lateral coils wound around oppositely arranged lateral first teeth of a first end of the first long side and the second long side form a first lateral coil set and the lateral coils wound around oppositely arranged lateral first teeth of a second end of the first long side and second long side form a second lateral coil set, inner coils wound around respective first teeth located between the lateral first teeth of the first long side and the second long side, wherein a first inner coil set is formed by inner coils wound around oppositely arranged inner teeth adjacent to the first lateral coil set and a second inner coil set is formed by inner coils wound around oppositely arranged inner teeth adjacent to the second lateral coil set, lower coils wound around a respective second tooth, wherein lower coils wound around oppositely arranged lateral second teeth of a first end of the third long side and the fourth long side form a first lower coil set and lower coils wound around oppositely arranged lateral second teeth of a second end of the third long side and the fourth long side form a second lower coil set, a first power converter system configured to energize the first lateral coil set, the second lateral coil set, the first inner coil set and the second inner coil set, a second power converter system configured to energize the first lower coil set and the second lower coil set, and a control system configured to control the first power converter system to energize the first lateral coil set and the second lateral coil set to generate a first magnetic field having a first field direction, and to simultaneously control the first power converter system to energize the first inner coil set and the second inner coil set to generate a second magnetic field having a second field direction opposite to the first direction, and the control system being configured to, simultaneously as controlling the first power converter system to energize the first lateral coil set, the second lateral coil set, the first inner coil set and the second inner coil set, control the second power converter system to energize the first lower coil set and the second lower coil set to generate a third magnetic field having the first field direction.

An effect obtainable by this control of all the coil sets in combination with the magnetic decoupling of the upper magnetic core structure and the lower magnetic core structure is that a magnetic field distribution/flux density in molten metal in a mold is created where the double roll flow is pronounced for optimal final metal product quality.

According to one embodiment the number of lateral coils is at least four, the number of inner coils is at least four, and the number of lower coils is at least four.

According to one embodiment the upper magnetic core structure is mechanically separated from the lower magnetic core structure.

According to one embodiment the first power converter system is configured to energize the first lateral coil set, the second lateral coil set, the first inner coil set and the second inner coil set with DC current, and the second power converter system is configured to power the first lower coil set and the second lower coil set with a DC current.

According to one embodiment the first power converter system is configured to energize the first lateral coil set, the second lateral coil set, the first inner coil set, and the second inner coil set with AC current.

According to one embodiment the first power converter system comprises Np first power converters, where Np is an integer divisible by 4, and Nc is a total number of lateral coils and inner coils of each of the first long side and the second long side, wherein a first power converter k, with k being an integer less than or equal to Np/2 is connected to lateral coils and inner coils of the first long side according to k+Nc/Np*(i1−1) and i1=1, 2, . . . , Nc/Np and to lateral coils and inner coils of the second long side according to Nc/2+k+Nc/Np*(i2−1), where i1=1, 2, . . . , Nc/Np.

According to one embodiment a first power converter k, with k being an integer greater than Np/2 is connected to lateral coils and inner coils of the first long side according to Nc/2+k−Nc/Np+Nc/Np*(i1−1) and to lateral coils and inner coils of the second long side according to k−Nc/Np+Nc/Np*(i2−1).

According to one embodiment the second power converter system comprises two second power converters, wherein a second power converters m, where m is an integer equal to 1 or 2, is connected to a lower coil m, on the third long side and to a lower coil and to a lower coil m+(−1)^(m−1) on the fourth long side. Furthermore, a first power converter of the second power converter system (17) is configured to power the first lower coil set (18*a*) with a first DC current and a second power converter (17-2) of the second power converter system (17) is configured to power a second the second lower coil set (18*b*) with a second/different DC current.

According to one embodiment, a first set of the power converters of the first power converter system is configured to energize the first lateral coil set and the first inner coil set with a first DC current and a second set of the power converters of the first converter system is configured to energize the second lateral coil set and the second inner coil set with a second/different current.

Alternatively, when AC is connected to the first power system, a first set of the power converters of the first power converter system is configured to energize the first lateral coil set and the first inner coil set with a first AC current amplitude and a second set of the power converters of the first converter system is configured to energize the second lateral coil set and the second inner coil set with a second AC current amplitude, wherein the second AC current amplitude is different than the first amplitude.

Particularly casting in the slab format is subject to flow asymmetries in the mold due to asymmetric slide-gate positioning or inhomogeneous clogging in the SEN. Asymmetric flow conditions may lead to large variations of the metal end product quality over the solidified slab surface, e.g. the left side of the slab may contain large clusters of non-metallic inclusions due to violent meniscus behavior on this side in the mold whereas a much lower number of defects on the right side indicate a much more stable casting situation here. Due to the individual control provided by the first power converter/second power converter combination and/or third power converter/fourth power converter combination, local counter-action of asymmetric flow conditions on left and right sides of a slabs mold is enabled.

The flow situations may be different in the upper and lower regions of a mold. Hence, the required electromagnetic fields in the upper and lower regions, as well as in left and right sides, may differ. For optimal flexibility in treating this situation and counter-acting undesired flows, maximum magnetic independence of upper and lower region magnetic fields is provided by means of the individual pole pair control provided by the first power converter/second power converter for the upper mold region and the third power converter and fourth power converter for the lower mold region.

There is according to a second aspect of the present disclosure provided a method of controlling an electromagnetic brake system for a metal-making process, wherein the electromagnetic brake system comprises: an upper magnetic core structure having a first long side and a second long side, wherein the first long side and the second long side are mounted to opposite longitudinal sides of an upper portion of a mold, each of the first long side and the second long side being provided with a plurality of first teeth, a lower magnetic core structure having a third long side and a fourth long side, wherein the third long side and the fourth long side are mounted to opposite longitudinal sides of a lower portion of a mold, each of the third long side and the fourth long side being provided with a plurality of second teeth, wherein the upper magnetic core structure and the lower magnetic core structure are magnetically decoupled, lateral coils wound around respective lateral first teeth of the first long side and the second long side, wherein the lateral coils wound around oppositely arranged lateral first teeth of a first end of the first long side and the second long side form a first lateral coil set and the lateral coils wound around oppositely arranged lateral first teeth of a second end of the first long side and second long side form a second lateral coil set, inner coils wound around respective first teeth located between the lateral first teeth of the first long side and the second long side, wherein a first inner coil set is formed by inner coils wound around oppositely arranged inner teeth adjacent to the first lateral coil set and a second inner coil set is formed by inner coils wound around oppositely arranged inner teeth adjacent to the second lateral coil set, lower coils wound around a respective second tooth, wherein lower coils wound around oppositely arranged lateral second teeth of a first end of the third long side and the fourth long side form a first lower coil set and lower coils wound around oppositely arranged lateral second teeth of a second end of the third long side and the fourth long side form a second lower coil set, a first power converter system configured to energize the first lateral coil set, the second lateral coil set, the first inner coil set and the second inner coil set, a second power converter system configured to energize the first lower coil set and the second lower coil set, wherein the method comprises: a) controlling by means of a control system the first power converter system to energize the first lateral coil set and the second lateral coil set to generate a first magnetic field having a first field direction, and simultaneously controlling the first power converter system to energize the first inner coil set and the second inner coil set to generate a second magnetic field having a second field direction opposite to the first direction, and b) controlling by means of the control system, simultaneously as step a), the second power converter system to energize the first lower coil set and the second lower coil set to generate a third magnetic field having the first field direction.

According to one embodiment the upper magnetic core structure is mechanically separated from the lower magnetic core structure.

According to one embodiment in the steps a) and b) of controlling, the first power converter system is configured to energize the first lateral coil set, the second lateral coil set, the first inner coil set and the second inner coil set with DC current, and the second power converter system is configured to power the first lower coil set and the second lower coil set with a DC current.

According to one embodiment in steps a) and b) the first power converter system is configured to energize the first lateral coil set, the second lateral coil set, the first inner coil set, and the second inner coil set with AC current.

According to one embodiment the first power converter system comprises Np first power converters, where Np is an integer divisible by 4, and Nc is a total number of lateral coils and inner coils of each of the first long side and the second long side, wherein a first power converter k, with k being an integer less than or equal to Np/2 is connected to lateral coils and inner coils of the first long side according to k+Nc/Np*(i1−1) and i1=1, 2, . . . , Nc/Np and to lateral coils and inner coils of the second long side according to Nc/2+k+Nc/Np*(i2−1), where i2=1, 2, . . . , Nc/Np.

According to one embodiment a first power converter k, with k being an integer greater than Np/2 is connected to lateral coils and inner coils of the first long side according to Nc/2+k−Nc/Np+Nc/Np*(i1−1) and to lateral coils and inner coils of the second long side according to k−Nc/Np+Nc/Np*(i2−1).

According to one embodiment the second power converter system comprises two second power converters, wherein a second power converters m, where m is an integer equal to 1 or 2, is connected to a lower coil m, on the third long side and to a lower coil and to a lower coil m+(−1)^(m−1) on the fourth long side.

According to one embodiment, wherein in the steps a) and b) of controlling, the method further comprises steps of energizing the first lateral coil set and the first inner coil set with a first DC current and energizing the second lateral coil set and the second inner coil set with a second/different DC current.

According to one embodiment, wherein in the steps a) and b) of controlling, the method further comprises steps of energizing the first lower coil set with a first DC current and energizing the second lower coil set with a second/different DC current.

According to one embodiment, wherein in the steps a) and b) of controlling, the method further comprises steps of energizing the first lateral coil set and the first inner coil set with a first AC current amplitude and energizing the second lateral coil set, and the second inner coil set with a second AC current amplitude, wherein the second amplitude is different than the first amplitude.

Generally, all terms used in the claims are to be interpreted according to their ordinary meaning in the technical field, unless explicitly defined otherwise herein. All references to "a/an/the element, apparatus, component, means, etc.," are to be interpreted openly as referring to at least one instance of the element, apparatus, component, means, etc., unless explicitly stated otherwise. Moreover, the steps of the method need not necessarily have to be carried out in the indicated order unless explicitly stated.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

The electromagnetic brake systems presented herein may be utilized in metal-making, more specifically in casting. Examples of metal-making processes are steelmaking and aluminum-making. The electromagnetic brake system may beneficially be utilized in for example a continuous casting process.

Figure 1:
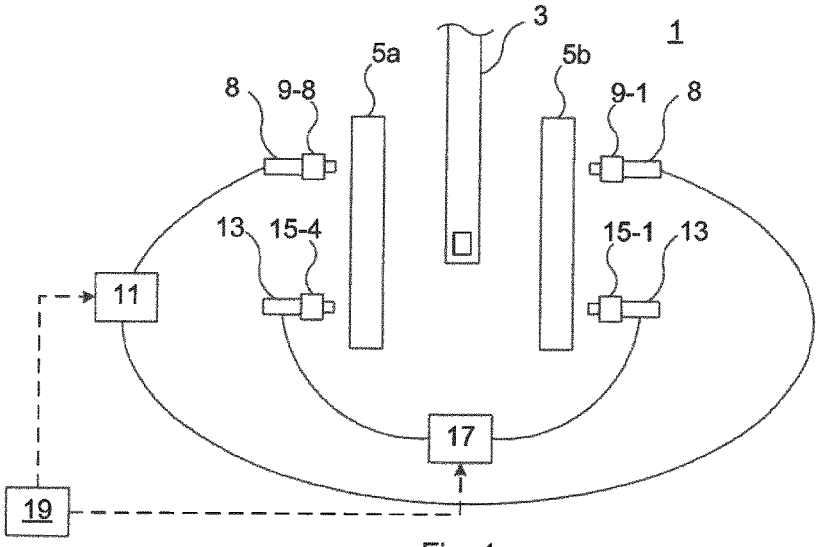
FIG. 1 schematically shows a side view of an example of an electromagnetic brake system.

FIG. 1 shows an example of a mold set-up 1, including an SEN 3, and mold plates 5*a* and 5*b* forming a mold. The SEN 3 is in a position between the mold plates 5*a* and 5*b* in the mold. The mold set-up 1 also includes an electromagnetic brake system 7 configured to provide braking and/or stirring of molten metal in the mold.

The electromagnetic brake system 7 includes an upper magnetic core 8 provided with coils, such as lateral coils 9-1, 9-8. The electromagnetic brake system 7 also includes a first power converter system 11 configured to power or energize the coils of the upper magnetic core 8. The first power converter system 11 may comprise one or more first power converters. The first power converter system 11 is configured to provide DC current and/or AC current to the coils of the upper magnetic core 8.

The electromagnetic brake system 7 also includes a lower magnetic core structure 13 provided with coils, such as lower coils 15-1, 15-4. The upper magnetic core 8 and the lower magnetic core structure 13 are magnetically decoupled. In particular, the upper magnetic core 8 and the lower magnetic core structure 13 are physically separate entities.

The electromagnetic brake system 7 also includes a second power converter system 17 configured to power or energize the coils of the lower magnetic core structure 13. The second power converter system 17 may comprise one or more second power converters. The second power converter system 17 is configured to provide DC current to the coils of the lower magnetic core structure 13.

The electromagnetic brake system 7 also includes a control system 19 configured to control each of the first power converter system 11 and the second power converter system 17 individually. Additionally, if the first power converter system 11 includes more than a single first power converter, the control system 19 is configured to control each one of these first power converters individually. Moreover, if the second power converter system 17 includes more than a single second power converter, the control system 19 is configured to control each one of these second power converters individually.

Each power converter of the first power converter system and the second power converter system is a current source, for example a drive, such as the ABB® DCS 800 MultiDrive.

Figure 2A:
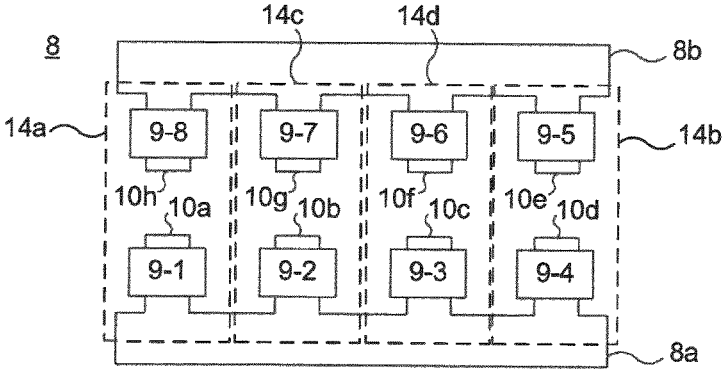
FIG. 2*a* schematically shows a top view of an upper magnetic core structure.
Figure 2B:
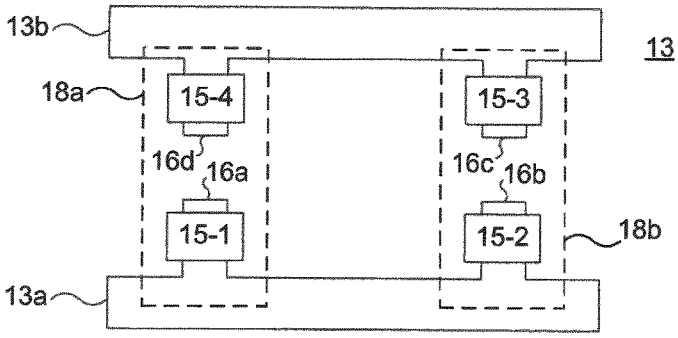
FIG. 2*b* schematically shows a top view of a lower magnetic core structure.

FIG. 2*a* shows one example configuration of the upper magnetic core structure 8 provided with coils, and FIG. 2*b* shows one example configuration of the lower magnetic core structure 13 provided with coils. This is the minimal set-up in which the coil control as will be described herein operates.

The upper magnetic structure 8 has a first long side 8*a* and a second long side 8*b* opposite to the first long side 8*a*. The first long side 8*a* and the second long side 8*b* are configured to be mounted to upper portions of opposite longitudinal sides/broad faces of a mold. Each of the first long side 8*a* and the second long side 8*b* comprises a plurality of first teeth 10*a*-10*h*. In the example, first teeth 10*a*, 10*d*, 10*e* and 10*h* are lateral first teeth and first teeth 10*b*-*c* and 10*f*-*g* are inner first teeth. Lateral first teeth 10*a* and 10*h* are located at a first end of the first long side 8*a* and second long side 8*b*. Lateral first teeth 10*d* and 10*e* are located at a second end, opposite to the first end, of the first long side 8*a* and the second long side 8*b*.

As noted above, the electromagnetic brake system 7 comprises a plurality of coils, in this example for example coils 9-1 to 9-8. Lateral coils 9-1, 9-4, 9-5 and 9-8 are wound around a respective first lateral tooth 10*a*, 10*d*, 10*e*, and 10*h*. Inner coils 9-2, 9-3 and 9-6, 9-7 are wound around a respective inner tooth 10*b*, 10*c*, 10*f* and 10*g*.

In this example lateral coils 9-1 and 9-8 of the first end form a first lateral coil set 14*a*. Lateral coils 9-4 and 9-5 of the second end form a second coil set 14*b*. Inner coils 9-2, 9-7 adjacent to the first lateral coil set 14*a* form a first inner coil set 14*c* and inner coils and 9-3, 9-6 adjacent to the second lateral coil set 14*b* form a second inner coil set 14*d*.

The control system 19 is configured to control the first power converter system 11 to energize the first lateral coil set 14*a* and the second lateral coil set 14*b* to create a first magnetic field having a first field direction. The control system 19 is furthermore configured to control the first power converter system 11 to simultaneously energize the first inner coil set 14*c* and the second inner coil set 14*d* to create a second magnetic field having a second field direction opposite to the first field direction.

When in use, this provides two horizontal magnetic fields in molten metal in a mold, having opposite directions.

FIG. 2*b* shows an example of the lower magnetic core structure 13. The lower magnetic core structure 13 has a third long side 13*a* and a fourth long side 13*b*. The third long side 13*a* and the fourth long side 13*b* are configured to be mounted to the lower portions of opposite longitudinal sides/broad faces of a mold. Each of the third long side 13*a* and the fourth long side 13*c* is provided with a plurality of second teeth 16*a*-16*d*.

The electromagnetic brake system 7 also comprises a plurality of lower coils 15-1, 15-2, 15-3, 15-4 wound around a respective second tooth 16*a*-16*d*. Lower coils 15-1 and 15-4 are lateral lower coils, and are provided on oppositely arranged teeth 16*a* and 16*d* of the third long side 13*a* and the fourth long side 13*b*, respectively. They form a first lower coil set 18*a*. Likewise, lower coils 15-2 and 15-3 are lateral lower coils, and are provided on oppositely arranged teeth 16*b* and 16*c* of the third long side 13*a* and the fourth long side 13*b*, respectively. Lower coils 15-2 and 15-*c* form a second lower coil set 18*b*.

The control system 19 is configured to control the second power converter system 17 simultaneously as the above-described control of the first lateral coil set 14*a*, the second lateral coil set 14*b*, the first inner coil set 14*c* and the second inner coil set 14*d*, to energize the first lower coil set 18*a* and the second lower coil set 18*b* to create a third magnetic field having the first field direction. The third magnetic field hence has the same field direction as the first magnetic field provided by the upper magnetic core structure 8. In this manner, a pronounced double roll flow may be created.

Figure 3A:
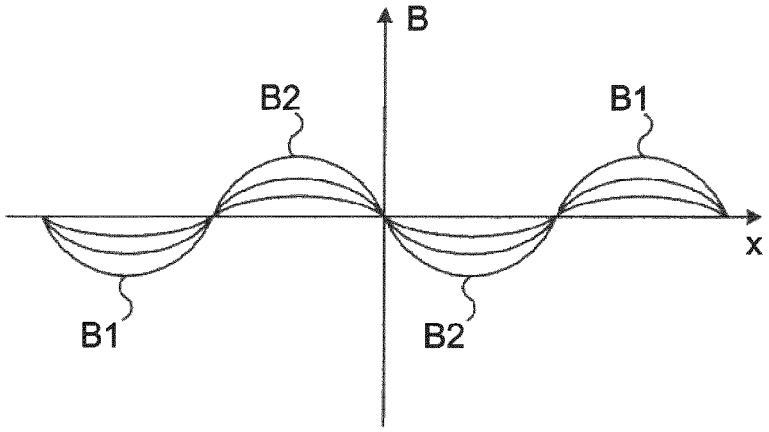
FIG. 3*a* shows the magnetic field distribution along an upper long side of a mold.

FIG. 3*a* depicts the magnetic field distribution along the oppositely arranged longitudinal sides/broad faces of a mold, as created by the upper magnetic core structure 8. The y-axis shows the magnetic field B and the x-axis shows the position along the broad face of the mold. The first magnetic field B1, as created by the first lateral coil set 14*a* and the second lateral coil set 14*b*, and the second magnetic field B2, as created by the first inner coil set 14*c* and the second inner coil set 14*d* are shown.

Figure 3B:
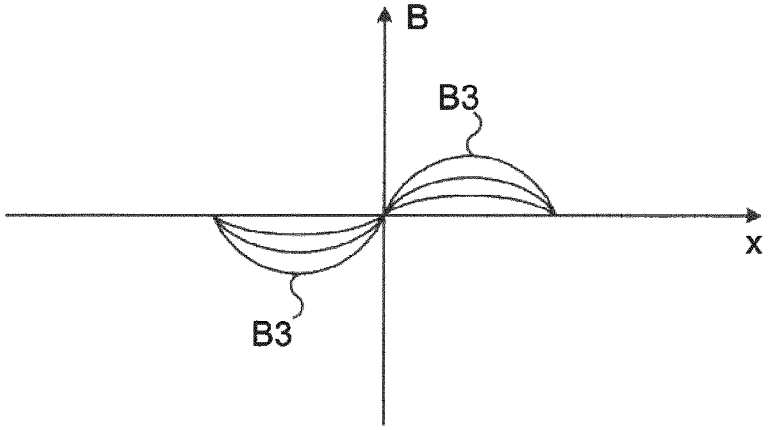
FIG. 3*b* shows the magnetic field distribution along a lower long side of a mold.

FIG. 3*b* is similar to FIG. 3*a*, but shows the magnetic field B created by the lower magnetic core structure 13 along a lower portion of the mold. Here, the third magnetic field B3 is shown, as created by the first lower coil set 18*a* and the second lower coil set 18*b*.

Figure 3C:
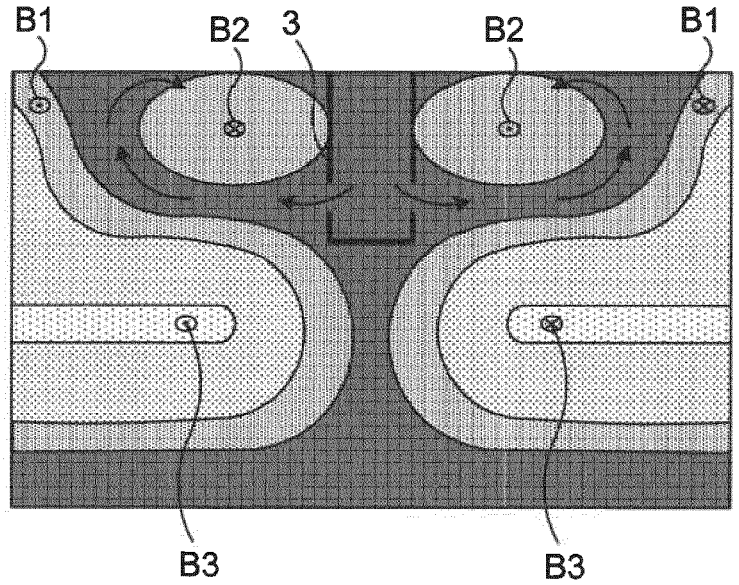
FIG. 3*c* shows the magnetic flux density as seen from the broad face of a mold.

FIG. 3*c* shows the magnetic flux density created in the molten metal by means of the upper magnetic core structure 8 and the lower magnetic core structure 13 and the control described above to create a pronounced double roll flow in the molten metal. The first magnetic field B1 and the second magnetic field B2 are shown in the upper portion of the illustration and the third magnetic field B3 is shown in the lower portion. The arrows show the double roll flow pattern created in the melt.

Figure 4A:
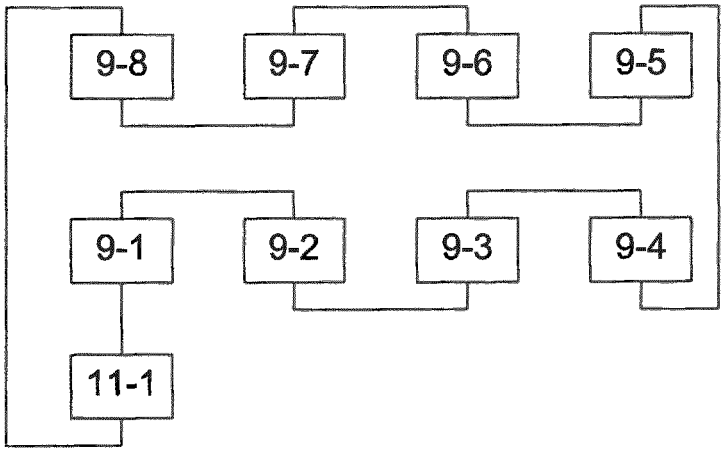
FIG. 4*a* shows an example of connecting a plurality of lateral and inner coils.
Figure 4B:
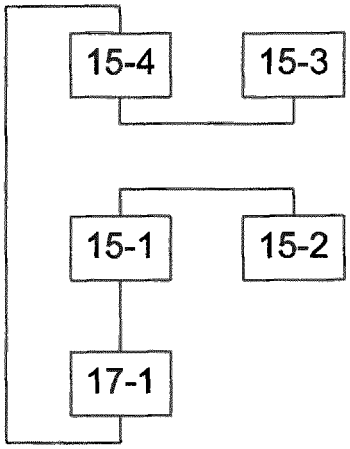
FIG. 4*b* shows an example of connecting a plurality of lower coils.

FIGS. 4*a* and 4*b* show one example of how the coils can be connected using a single first power converter 11-1 to energize the first lateral coil set 14*a*, the second lateral coil set 14*b* and the first inner coil set 14*c* and the second inner coil set 14*d*, and a single second power converter 17-1 to energize the first lower coil set 18*a* and the second lower coil set 18*b*.

All of the lateral and inner coils 9-1 to 9-8 are series-connected with each other and with the first power converter 11-1. All of the lower coils 15-1 to 15-4 are series-connected with each other and with the second power converter 17-1. By means of these connections, the above-described magnetic field distribution may be obtained using a single first power converter 11-1 to power the coils wound around the first teeth of the upper magnetic core structure 8 and a single second power converter 17-1 to power the coils wound around the second teeth of the lower magnetic core structure 13.

A general connection scheme valid when the first power converter system 11 comprises Np first power converters, where Np is an integer evenly divisible by 4 will now be described.

Nc denoted the total number of coils of each of the first long side and the second long side of the upper magnetic core structure 8. As an example, Nc is four in the set-up of FIG. 2*a*. When describing this connection scheme, there will be no distinguishing between lateral coils and inner coils; all coils wound around first teeth will simply be referred to as "coils". The k:th first power converter, with k less than or equal to Np/2, is connected coils along the first long side 8*a* according to k+Nc/Np*(i1−1) with i1=1, 2, . . . , Nc/Np and to lateral coils of the second long side according to Nc/2−Fk+Nc/Np*(i2−1), where i2=1, 2, . . . , Nc/Np. It should be noted that the numbering of the coils is from left to right along the first long side 8*a* and from the right to left along the second long side 8*b*. The numbering of the coils is hence made in a circular manner.

When k is an integer greater than Np/2, a first power converter k, is connected to coils of the first long side according to Nc/2+k−Nc/Np+Nc/Np*(i1−1) and to coils of the second long side according to k−Nc/Np+Nc/Np*(i2−1).

A general connection scheme for the lower coils, valid when the second power converter system 17 comprises two second power converters will now be described. According to this connection scheme, a second power converters m, where m is an integer equal to 1 or 2, is connected to a lower coil m, on the third long side and to a lower coil and to a lower coil m+(−1)^(m−1) on the fourth long side. The numbering of the coils is from the left to right along the third long side 13*a* and from right to left along the fourth long side 13*b*.

By means of these general connection schemes, a pronounced double roll flow pattern may be obtained using the previously described control of the first power converter system and the second power converter system.

Additionally, asymmetric flow control may also be provided. In particular, individual magnetic fields can be provided on the left/right side in the upper level of the mold, and independently also in the lower level of the mold, thus enabling a reactive flow control depending on the left/right and upper/lower level asymmetry of the flow pattern in the mold.

The symmetry of the magnetic fields and flow control in the upper level of the mold is independent from the type of flow control in the lower level of the mold. For example, under certain circumstances, asymmetric flow control on the left/right side in the upper level of the mold may be combined with symmetric flow control on the left/right side in the lower level of the mold or symmetric flow control in the upper level of the mold, may be combined with asymmetric flow control in the lower level of the mold. It is also possible to provide symmetric flow control on both upper and lower levels of the mold or provide independent asymmetric flow control on both upper and lower levels of the mold.

During the casting process, the flow pattern of the molten metal in the mold may display asymmetric features due to deviations from ideal conditions in the mold or upstream in the SEN, which results in inhomogeneous SEN clogging, asymmetric stopper or slide-gate positioning, or asymmetric argon injection. Even with a perfectly aligned and symmetric geometry, the turbulence of the fluid flow in the SEN and mold induces flow variations that cause asymmetric flow patterns to various extent. These asymmetric flow conditions may lead to large local variations of the metal end-product quality, e.g. the left side of a solidified slab may contain large clusters of non-metallic inclusions close to the surface due to violent meniscus behavior and mold powder entrainment on the left side.

By applying asymmetric flow control, the asymmetry in the mold flow pattern can be mitigated, thus maintaining a more stable and symmetric casting process. E.g., excessive meniscus fluctuations and flow speeds on one side of the mold can be mitigated by extra stabilization and braking in this area, or an uneven speed relationship between the SEN jets due to SEN clogging can be homogenized by applying more braking on one side of the lower portion of the mold. A homogeneous solidified end-product, and flexible and localized casting process control are among the advantages of asymmetric flow control.

Figure 5A:
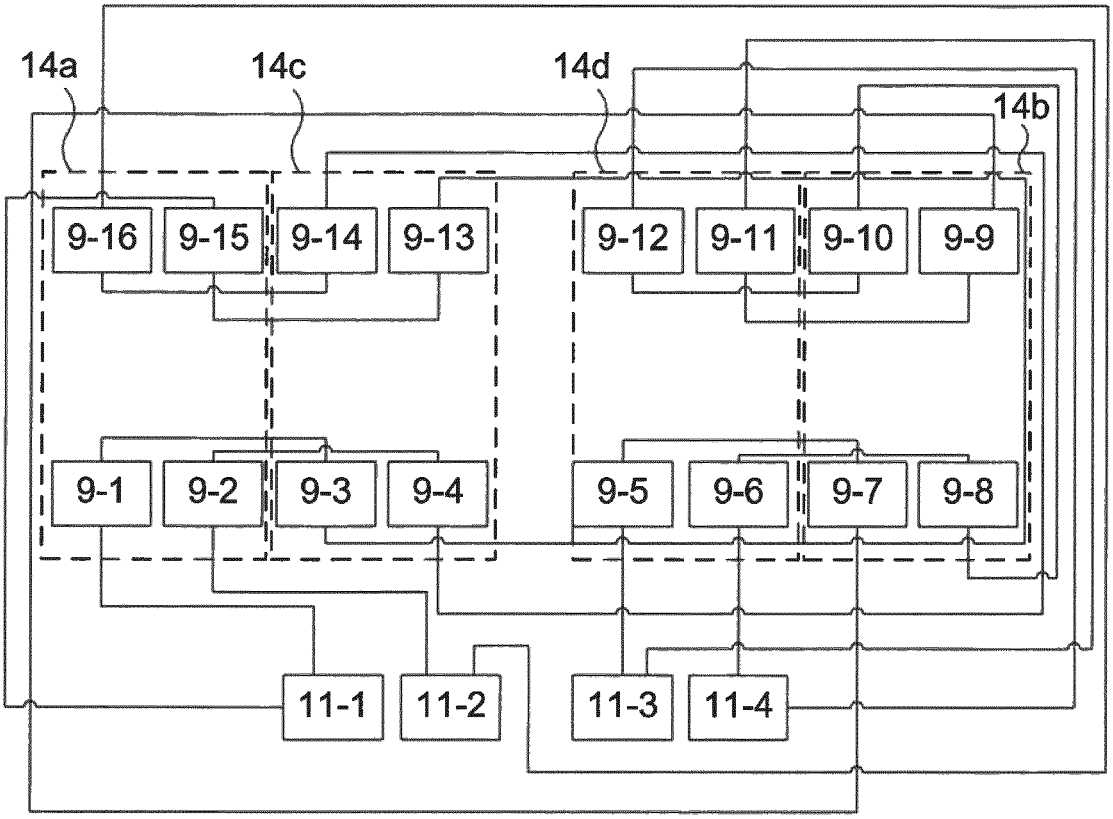
FIG. 5*a* shows another example of a connection of a plurality of lateral and inner coils.

FIG. 5*a* shows a connection example according to the connection scheme for the upper coils, with a total of sixteen coils 9-1 to 9-16 wound around a respective one of sixteen first teeth of the upper magnetic core structure, which for reasons of clarity has been omitted. The exemplified electromagnetic brake system in FIG. 5*a* includes a first power converter system having four first power converters 11-1 to 11-4. Lateral coils 9-1, 9-2 and oppositely arranged lateral coils 9-16 and 9-15 of a first end of the upper magnetic core structure form the first lateral coil set 14*a* and lateral coils 9-7, 9-8 and lateral coils 9-9 and 9-10 of a second end of the upper magnetic core structure form the second lateral coil set 14*b*. Inner coils 9-3 and 9-4 and oppositely arranged inner coils 9-14 and 9-13 form the first inner coils set 14*c* located adjacent to the first lateral coil set 14*a*, Inner coils 9-5, 9-6 and oppositely arranged inner coils 9-12 and 9-11 form the second inner coil set 14*d* located adjacent to the second lateral coil set 14*b*. First power converters 11-1 and 11-2 control the operation of the first lateral coil set 14*a* and the first inner coil set 14*c*, and first power converters 11-3 and 11-4 control the operation of the second lateral coil set 13*b* and the second inner coil set 14*d*. The control system 19 is configured to control these so that the first lateral coil set 14*a* and the second lateral coil set 14*b* creates a first magnetic field in a first direction, and so that the first inner coil set 14*c* and the second inner coil set 14*d* create a second magnetic field in the second direction.

Figure 5B:
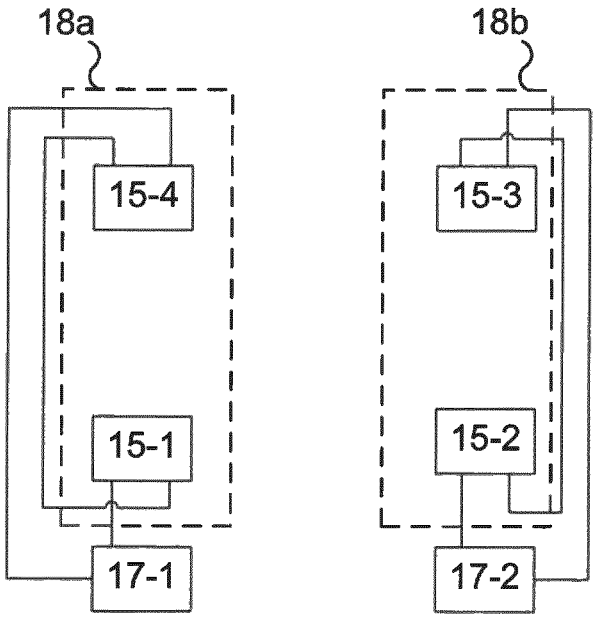
FIG. 5*b* shows another example of a connection of a plurality of lower coils.

FIG. 5*b* depicts a connection example according to the connection scheme for the lower coils, with a total of four coils 15-1 to 15-4 wound around a respective one of the four second teeth of the lower magnetic core structure, which for reasons of clarity has been omitted. The exemplified electromagnetic brake system in FIG. 5*b* includes a second power converter system having two first power converters 17-1 and 17-2. Oppositely arranged lower coils 15-1 and 15-4, i.e. arranged on the third long side and fourth long side, respectively, form the first lower coil set 18*a* and oppositely arranged lower coils 15-2 and 15-3 form the second lateral coil set 14*b*. A second power converter 17-1 controls the operation of the first lower coil set 18*a*, and second power converter 17-2 control the operation of the second lower coil set 18*b*. The control system 19 is configured to control these so that the first lower coil set 18*a* and the second lower coil set 18*b* creates a third magnetic field in the first direction.

Figure 6:
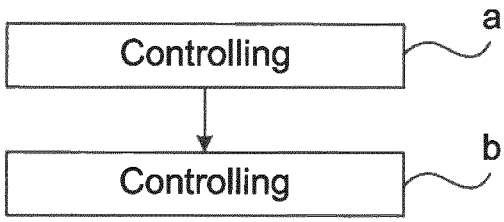
FIG. 6 is a flowchart of a method of controlling an electromagnetic brake system.

FIG. 6 shows a flowchart of a method of controlling the electromagnetic brake system 7.

In a step a) the first power converter system 11 is controlled to energize the first lateral coil set 14*a* and the second lateral coil set 14*b* to generate a first magnetic field having a first field direction, and simultaneously to control the first power converter system 11 to energize the first inner coil set 14*c* and the second inner coil set 14*d* to generate a second magnetic field having a second field direction opposite to the first direction.

Simultaneously as step a) the second power converter system 17 is controlled to energize the first lower coil set and the second lower coil set to generate a third magnetic field having the first field direction.

Asymmetric flow control is enabled by the method of controlling the electromagnetic brake system by the application of uneven currents within the power converter systems. The individual power converters in a given power converter system, may feed the coils with different DC currents and/or AC current amplitudes, thus distributing different currents to individual coils, consequently applying an uneven magnetic field distribution along a long side.

Thus, for the example shown in FIG. 5*a*, individual flow control can be provided on the left/right side in the upper level of the mold by configuring the currents from the individual power converters (11-1, 11-2, 11-3, 11-4) in power converter system 11 unevenly so that the current energizing the first lateral and inner coil sets on the left side, (14-*a*, 14-*c*) is different from the current energizing the second lateral and inner coil sets on the right side, (14-*b*, 14-*d*). Independently, for the example of FIG. 5*b*, individual flow control can be provided on the left/right side in the lower level of the mold by configuring the currents from the individual power converters (17-1, 17-2) in power converter system 17 unevenly so that the current energizing the coil set on the left side, (18-*a*) is different from the current energizing the coil set on the right side, (18-*b*).

Figure 7A:
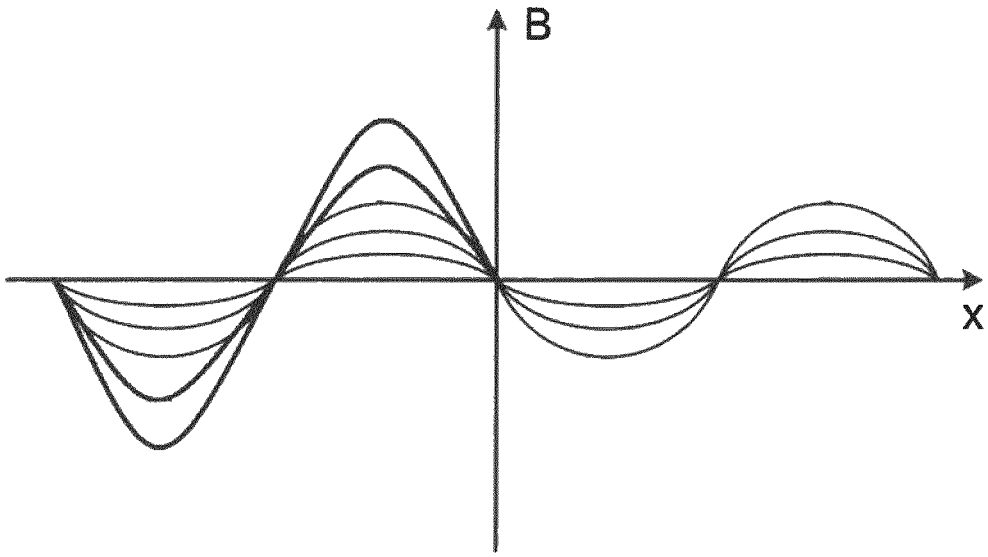
FIG. 7*a* depicts an asymmetric magnetic field distribution along the oppositely arranged longitudinal sides/broad faces of a mold, as created by an upper magnetic core structure with uneven currents.

FIG. 7*a* depicts an asymmetric magnetic field distribution along the oppositely arranged longitudinal sides/broad faces of a mold, as created by the upper magnetic core structure 8 with uneven currents within the power converter system (11). The y-axis shows the magnetic field B and the x-axis shows the position along the broad face of the mold. The first magnetic field B1, as created by the first lateral coil set 14*a* and the second lateral coil set 14*b*, and the second magnetic field B2, as created by the first inner coil set 14*c* and the second inner coil set 14*d* are shown. Here the current magnitude of the first lateral coil set 14*a* and the first inner coil set 14*c* is higher than for the second lateral coil set 14*b* and the second inner coil set 14*d* to infer stronger flow control in the left side of the upper part of the mold.

Figure 7B:
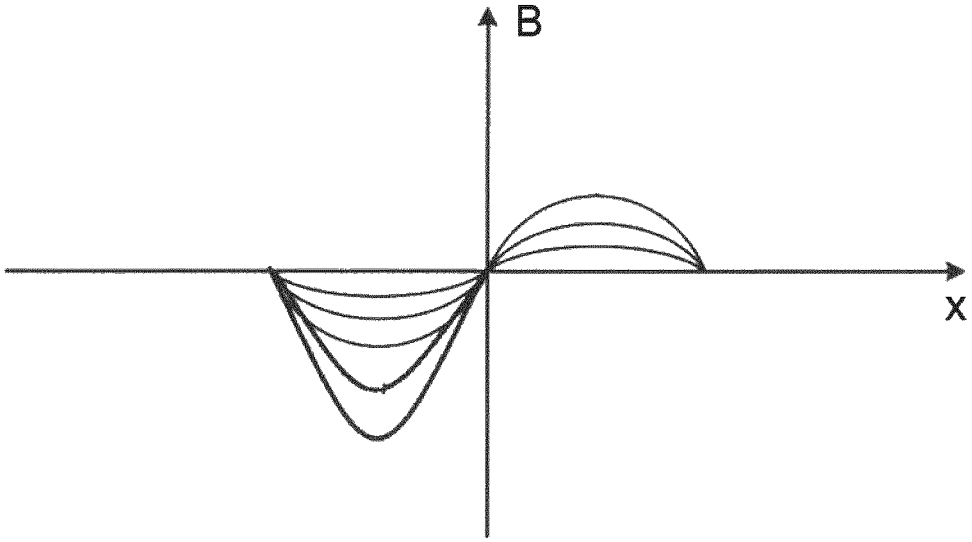
FIG. 7*b* illustrates an asymmetric magnetic field created by a lower magnetic core structure with uneven currents.

Similarly, FIG. 7*b* shows an asymmetric magnetic field created by the lower magnetic core structure 13 with uneven currents within the power converter system (17) along a lower portion of the mold. Here, the third magnetic field B3 is shown, as created by the first lower coil set 18*a* and the second lower coil set 18*b*. In this example, the current magnitude of the first coil set 18*a* is higher than for the second coil set 18*b* and the second in order to infer stronger flow control in the left side of the lower part of the mold.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. An electromagnetic brake system for a metal-making process, wherein the electromagnetic brake system comprises:

an upper magnetic core structure having a first long side and a second long side, wherein the first long side and the second long side are configured to be mounted to opposite longitudinal sides of an upper portion of a mold, each of the first long side and the second long side being provided with a plurality of first teeth, a lower magnetic core structure having a third long side and a fourth long side, wherein the third long side and the fourth long side are configured to be mounted to opposite longitudinal sides of a lower portion of a mold, each of the third long side and the fourth long side being provided with a plurality of second teeth, wherein the upper magnetic core structure and the lower magnetic core structure are magnetically decoupled, lateral coils wound around respective lateral first teeth of the first long side and the second long side, wherein the lateral coils wound around oppositely arranged lateral first teeth of a first end of the first long side and the second long side form a first lateral coil set and the lateral coils wound around oppositely arranged lateral first teeth of a second end of the first long side and second long side form a second lateral coil set, inner coils wound around respective first teeth located between the lateral first teeth of the first long side and the second long side, wherein a first inner coil set is formed by inner coils wound around oppositely arranged inner teeth adjacent to the first lateral coil set and a second inner coil set is formed by inner coils wound around oppositely arranged inner teeth adjacent to the second lateral coil set, lower coils wound around a respective second tooth, wherein lower coils wound around oppositely arranged lateral second teeth of a first end of the third long side and the fourth long side form a first lower coil set and lower coils wound around oppositely arranged lateral second teeth of a second end of the third long side and the fourth long side form a second lower coil set, a first power converter system configured to energize the first lateral coil set, the second lateral coil set, the first inner coil set and the second inner coil set, a second power converter system configured to energize the first lower coil set and the second lower coil set, and a control system configured to control the first power converter system to energize the first lateral coil set and the second lateral coil set to generate a first magnetic field having a first field direction, and to simultaneously control the first power converter system to energize the first inner coil set and the second inner coil set to generate a second magnetic field having a second field direction opposite to the first direction, and the control system being configured to, simultaneously as controlling the first power converter system to energize the first lateral coil set, the second lateral coil set, the first inner coil set and the second inner coil set, control the second power converter system to energize the first lower coil set and the second lower coil set to generate a third magnetic field having the first field direction.

2. The electromagnetic brake system as claimed in claim 1, wherein the number of lateral coils is at least four, the number of inner coils is at least four, and the number of lower coils is at least four.

3. The electromagnetic brake system as claimed in claim 1, wherein the upper magnetic core structure is mechanically separated from the lower magnetic core structure.

4. The electromagnetic brake system as claimed in claim 1, wherein the first power converter system is configured to energize the first lateral coil set, the second lateral coil set, the first inner coil set and the second inner coil set with DC current, and the second power converter system is configured to power the first lower coil set and the second lower coil set with a DC current.

5. The electromagnetic brake system as claimed in claim 4, wherein a first set of the power converters of the first power converter system is configured to energize the first lateral coil set and the first inner coil set with a first DC current and a second set of the power converters of the first converter system is configured to energize the second lateral coil set and the second inner coil set with a second/different current.

6. The electromagnetic brake system as claimed in claim 4, and wherein a first power converter of the second power converter system is configured to power the first lower coil set with a first DC current and a second power converter of the second power converter system is configured to power a second the second lower coil set with a second/different DC current.

7. The electromagnetic brake system as claimed in claim 4, wherein a first set of the power converters of the first power converter system is configured to energize the first lateral coil set and the first inner coil set with a first AC current amplitude and a second set of the power converters of the first converter system is configured to energize the second lateral coil set and the second inner coil set with a second AC current amplitude, wherein the second AC current amplitude is different than the first amplitude.

8. The electromagnetic brake system as claimed in claim 1, wherein the first power converter system is configured to energize the first lateral coil set, the second lateral coil set, the first inner coil set and the second inner coil set with AC current.

9. The electromagnetic brake system as claimed in claim 1, wherein the first power converter system includes Np first power converters, where Np is an integer divisible by 4, and Nc is a total number of lateral coils and inner coils of each of the first long side and the second long side, wherein a first power converter k, with k being an integer less than or equal to Np/2 is connected to lateral coils and inner coils of the first long side according to k+Nc/Np*(i1−1) and i1=1, 2, . . . , Nc/Np and to lateral coils and inner coils of the second long side according to Nc/2+k+Nc/Np*(i2−1), where i2=1, 2, . . . , Nc/Np.

10. The electromagnetic brake system as claimed in claim 9, wherein a first power converter k, with k being an integer greater than Np/2 is connected to lateral coils and inner coils of the first long side according to Nc/2+k−Nc/Np+Nc/Np*(i1−1) and to lateral coils and inner coils of the second long side according to k−Nc/Np+Nc/Np*(i2−1).

11. The electromagnetic brake system as claimed in claim 1, wherein the second power converter system includes two second power converters, wherein a second power converters m, where m is an integer equal to 1 or 2, is connected to a lower coil m, on the third long side and to a lower coil and to a lower coil m+(−1)^(m−1) on the fourth long side.

12. A method of controlling an electromagnetic brake system for a metal-making process, wherein the electromagnetic brake system comprises:

an upper magnetic core structure having a first long side and a second long side, wherein the first long side and the second long side are mounted to opposite longitudinal sides of an upper portion of a mold, each of the first long side and the second long side being provided with a plurality of first teeth, a lower magnetic core structure having a third long side and a fourth long side, wherein the third long side and the fourth long side are mounted to opposite longitudinal sides of a lower portion of a mold, each of the third long side and the fourth long side being provided with a plurality of second teeth, wherein the upper magnetic core structure and the lower magnetic core structure are magnetically decoupled, lateral coils wound around respective lateral first teeth of the first long side and the second long side, wherein the lateral coils wound around oppositely arranged lateral first teeth of a first end of the first long side and the second long side form a first lateral coil set and the lateral coils wound around oppositely arranged lateral first teeth of a second end of the first long side and second long side form a second lateral coil set, inner coils wound around respective first teeth located between the lateral first teeth of the first long side and the second long side, wherein a first inner coil set is formed by inner coils wound around oppositely arranged inner teeth adjacent to the first lateral coil set and a second inner coil set is formed by inner coils wound around oppositely arranged inner teeth adjacent to the second lateral coil set, lower coils wound around a respective second tooth, wherein lower coils wound around oppositely arranged lateral second teeth of a first end of the third long side and the fourth long side form a first lower coil set and lower coils wound around oppositely arranged lateral second teeth of a second end of the third long side and the fourth long side form a second lower coil set, a first power converter system configured to energize the first lateral coil set, the second lateral coil set, the first inner coil set and the second inner coil set, a second power converter system configured to energize the first lower coil set and the second lower coil set, wherein the method includes:

a) controlling by means of a control system the first power converter system to energize the first lateral coil set and the second lateral coil set to generate a first magnetic field having a first field direction, and simultaneously controlling the first power converter system to energize the first inner coil set and the second inner coil set to generate a second magnetic field having a second field direction opposite to the first direction, and b) controlling by means of the control system, simultaneously as step a) the second power converter system to energize the first lower coil set and the second lower coil set to generate a third magnetic field having the first field direction.

13. The method as claimed in claim 12, wherein the upper magnetic core structure is mechanically separated from the lower magnetic core structure.

14. The method as claimed in claim 12, wherein in the steps a) and b) of controlling, the first power converter system is configured to energize the first lateral coil set, the second lateral coil set, the first inner coil set and the second inner coil set with DC current, and the second power converter system is configured to power the first lower coil set and the second lower coil set with a DC current.

15. The method as claimed in claim 12, wherein in steps a) and b) the first power converter system is configured to energize the first lateral coil set, the second lateral coil set, the first inner coil set and the second inner coil set with AC current.

16. The method as claimed in claim 12, wherein the first power converter system includes Np first power converters, where Np is an integer divisible by 4, and Nc is a total number of lateral coils and inner coils of each of the first long side and the second long side, wherein a first power converter k, with k being an integer less than or equal to Np/2 is connected to lateral coils and inner coils of the first long side according to k+Nc/Np*(i1−1) and i1=1, 2, . . . , Nc/Np and to lateral coils and inner coils of the second long side according to Nc/2+k+Nc/Np*(i2−1), where i2=1, 2, . . . , Nc/Np.

17. The method as claimed in claim 16, wherein a first power converter k, with k being an integer greater than Np/2 is connected to lateral coils and inner coils of the first long side according to Nc/2+k−Nc/Np+Nc/Np*(i1−1) and to lateral coils and inner coils of the second long side according to k−Nc/Np+Nc/Np*(i2−1).

18. The method as claimed in claim 12, wherein the second power converter system includes two second power converters, wherein a second power converters m, where m is an integer equal to 1 or 2, is connected to a lower coil m, on the third long side and to a lower coil and to a lower coil m+(−1)^(m−1) on the fourth long side.

19. The method as claimed in claim 12, wherein in the steps a) and b) of controlling, the method further includes steps of energizing the first lateral coil set and the first inner coil set with a first DC current and energizing the second lateral coil set and the second inner coil set with a second/different DC current.

20. The method as claimed in claim 12, wherein in the steps a) and b) of controlling, the method further includes steps of energizing the first lower coil set with a first DC current and energizing the second lower coil set with a second/different DC current.

21. The method as claimed in claim 12, wherein in the steps a) and b) of controlling, the method further includes steps of energizing the first lateral coil set and the first inner coil set with a first AC current amplitude and energizing the second lateral coil set, and the second inner coil set with a second AC current amplitude, wherein the second amplitude is different than the first amplitude.

* * * * *